US009999289B2

(12) United States Patent
Bonnema et al.

(10) Patent No.: US 9,999,289 B2
(45) Date of Patent: Jun. 19, 2018

(54) SHOULDER STRAPS FOR BACKPACKS

(71) Applicant: Jansport Apparel Corp., Wilmington, DE (US)

(72) Inventors: Ahren Mitchell Bonnema, Castro Valley, CA (US); Eric Brown Rothenhaus, Oakland, CA (US); Howard Li, San Rafael, CA (US); Jayson Yagi, Oakland, CA (US)

(73) Assignee: Jansport Apparel Corp., Wilmington, DE (US)

( * ) Notice: Subject to any disclaimer, the term of this patent is extended or adjusted under 35 U.S.C. 154(b) by 0 days. days.

(21) Appl. No.: 15/189,513

(22) Filed: Jun. 22, 2016

(65) Prior Publication Data

US 2017/0238681 A1 Aug. 24, 2017

Related U.S. Application Data

(60) Provisional application No. 62/297,610, filed on Feb. 19, 2016.

(51) Int. Cl.
*A45F 3/04* (2006.01)
*A45F 3/12* (2006.01)

(52) U.S. Cl.
CPC ..... *A45F 3/04* (2013.01); *A45F 3/12* (2013.01); *A45F 2003/045* (2013.01)

(58) Field of Classification Search
CPC ..... A45F 3/04; A45F 3/12; A45F 2003/045
USPC ..... 224/643
See application file for complete search history.

(56) References Cited

U.S. PATENT DOCUMENTS 5,566,871 A * 10/1996 Weintraub ..... A45F 3/12 2/268
D408,962 S * 5/1999 Reagan ..... D2/639
6,017,094 A * 1/2000 Syiek ..... B60N 2/4879 297/482
6,170,959 B1 * 1/2001 Richardson ..... G08B 5/004 359/516
6,966,470 B1 * 11/2005 Charlton ..... A45C 13/26 135/66
7,025,237 B2 * 4/2006 Herold ..... A45F 3/14 224/264

(Continued)

FOREIGN PATENT DOCUMENTS

DE 29502899 U1 5/1995
EP 1380227 A2 1/2004

(Continued)

OTHER PUBLICATIONS

Keen Tilden Daypack. Keen, Inc., 2016 [retrieved on Aug. 3, 2016]. Retrieved from the Internet: <http://www.keenfootwear.com/product/bags/tilden-daypack>.

(Continued)

*Primary Examiner* — Peter Helvey
(74) *Attorney, Agent, or Firm* — Hunton Andrews Kurth LLP

(57) ABSTRACT

A backpack with improved shoulder straps includes a set of fold-over panels formed respectively on the shoulder straps, wherein each of the fold-over panels extends from an inner side of the shoulder strap on which it is formed, folds over the shoulder strap, and attaches to an outer side of the shoulder strap on which it is formed. The improved shoulder straps mitigate chafing around the neck of a user.

11 Claims, 9 Drawing Sheets

(56) References Cited

U.S. PATENT DOCUMENTS

| | | | | |
|---|---|---|---|---|
| D526,449 | S * | 8/2006 | Dawson | D29/122 |
| 7,086,926 | B2 * | 8/2006 | Falla | A41F 15/007 2/267 |
| D658,187 | S * | 4/2012 | Diebel | G06F 1/1628 D14/440 |
| D700,961 | S * | 3/2014 | Tellez | D24/110 |
| 8,708,207 | B2 * | 4/2014 | Wetzsteon | A45F 3/12 2/268 |
| 8,869,314 | B2 * | 10/2014 | Peper | A41F 15/02 2/244 |
| 9,610,866 | B2 * | 4/2017 | Mitsuo | B60N 2/2812 |
| 2002/0100781 | A1 * | 8/2002 | Finkelstein | A45F 3/12 224/264 |
| 2002/0108979 | A1 * | 8/2002 | Finkelstein | A45F 3/12 224/264 |
| 2004/0144820 | A1 * | 7/2004 | Herold | A45F 3/14 224/605 |
| 2006/0175367 | A1 * | 8/2006 | Khorshid | A45F 3/042 224/264 |
| 2008/0067210 | A1 * | 3/2008 | Meesey | A45C 13/30 224/643 |

FOREIGN PATENT DOCUMENTS

| | | |
|---|---|---|
| GB | 2512134 A | 9/2014 |
| JP | S5627029 U | 3/1981 |

OTHER PUBLICATIONS

European Patent Office, Extended European Search Report dated Jul. 28, 2017, 9 pages.

* cited by examiner

SHOULDER STRAPS FOR BACKPACKS

CROSS-REFERENCE TO RELATED APPLICATIONS

The present application claims priority to U.S. Provisional Application No. 62/297,610, filed Feb. 19, 2016, the entire contents of which are hereby incorporated by reference.

TECHNICAL FIELD

The present invention generally relates to backpacks, which can be used for travelling, or in a wide range of outdoor activities, such as hiking, camping, fishing, and the like.

BACKGROUND

Backpacks allow users to carry items by distributing the load across the users' shoulders and back. Typically, a backpack is held on a user's shoulders by shoulder straps, through which the user inserts her arms. Carrying cargo in a backpack can be a comfortable alternative to hand-carrying.

Conventional backpack shoulder straps suffer from several flaws. While conventional shoulder straps are often padded to reduce some strain and discomfort on a user's shoulders, simply padding shoulder straps has a limited effect on a user's comfort. Ordinary padded shoulder straps do little more than alleviate pressure directed into a user's shoulders. Conventional shoulder straps are typically flat and the inner sides of the straps lie in the curved region between a user's neck and shoulders. When weight is applied to these inner sides, chafing and muscle strain frequently occurs due to the presence of seams on the inner sides or other uncomfortable constructions.

Further, conventional shoulder straps lie awkwardly over a user's shoulders and upper back. While backpacks themselves may be soft and easily manipulated into different shapes, objects frequently carried in backpacks, such as books and laptop computers, are flat and hard. When these objects are carried in backpacks, the backpacks take on the flat shape of the object inside. Conventional shoulder straps are most often fastened to the top of a backpack by being sewn into the top seam. With such a configuration, the flat side of the body of the backpack may lie against the natural curvature of a user's back, resulting in pressure points and discomfort.

Accordingly, there is a need for a backpack with shoulder straps that reduce strain and chafing on the user's neck, shoulders, and back.

SUMMARY

One aspect of the present invention relates to backpacks with improved shoulder straps for increased user comfort. One example of such an apparatus may include a body, a first shoulder strap attached to the body, and a second shoulder strap attached to the body. The example apparatus may also include a first fold-over panel formed on the first shoulder strap, where the first fold-over panel extends from an inner side of the first shoulder strap, folds over the first shoulder strap, and attaches to an outer side of the first shoulder strap. The example apparatus may further include a second fold-over panel formed on the second shoulder strap, where the second fold-over panel extends from an inner side of the second shoulder strap, folds over the second shoulder strap, and attaches to an outer side of the second shoulder strap.

In one embodiment, the first fold-over panel and the second fold-over panel may fold over the first shoulder strap and the second shoulder strap respectively in a direction opposite of the body.

In another embodiment, the first fold-over panel and the second fold-over panel may be integrated with the first shoulder strap and the second shoulder strap respectively. The fold-over panels may further be constructed with a perforated foam.

Still another embodiment may include a sternum strap that is attached to the first shoulder strap underneath the first fold-over panel and is attached to the second shoulder strap underneath the second fold-over panel.

Another aspect of the present invention relates to a shoulder strap configuration for improving load distribution across a user's neck, shoulders, and back. An example of such an apparatus may include a body and a first shoulder strap including a first back panel, where an inner side of the first back panel is attached to the body and the first shoulder strap folds where the attachment between the inner side of the first back panel and the body ends. The apparatus may further include a second shoulder strap including a second back panel, where an inner side of the second back panel is attached to the body and the second shoulder strap folds where the attachment between the inner side of the first back panel and the body ends. The apparatus may further include a first load-stabilizing strap that is attached to both the body and the first shoulder strap and a second load-stabilizing strap that is attached to both the body and the second shoulder strap.

In one embodiment, an outer side of the first back panel and an outer side of the second back panel may be attached to the body. In another embodiment, at least a portion of an outer side of the first back panel and at least a portion of an outer side of the second back panel may be unattached to the body.

In still another embodiment, the first back panel and the second back panel may extend to a lower seam of the body. Still another embodiment may further include a lumbar panel attached to the body below the back panels.

In still another embodiment, the first back panel and the second back panel may be integrated with the first shoulder strap and the second shoulder strap respectively.

In still another embodiment, the first load-stabilizing strap may be attached to the first shoulder strap underneath the first fold-over panel and the second load-stabilizing strap may be attached to the second shoulder strap underneath the second fold-over panel.

BRIEF DESCRIPTION OF THE DRAWINGS

The present invention will become more fully understood from the detailed description given below and from the accompanying drawings. The drawings are intended to disclose but a few possible examples of the present invention, and thus do not limit the present invention's scope.

DETAILED DESCRIPTION

The present invention generally relates to improved shoulder straps. While a preferred example of shoulder straps is described in detail below in conjunction with a backpack, the shoulder straps described herein may also be applied to a broad variety of apparatuses such as safety vests and safety harnesses.

Figure 1:
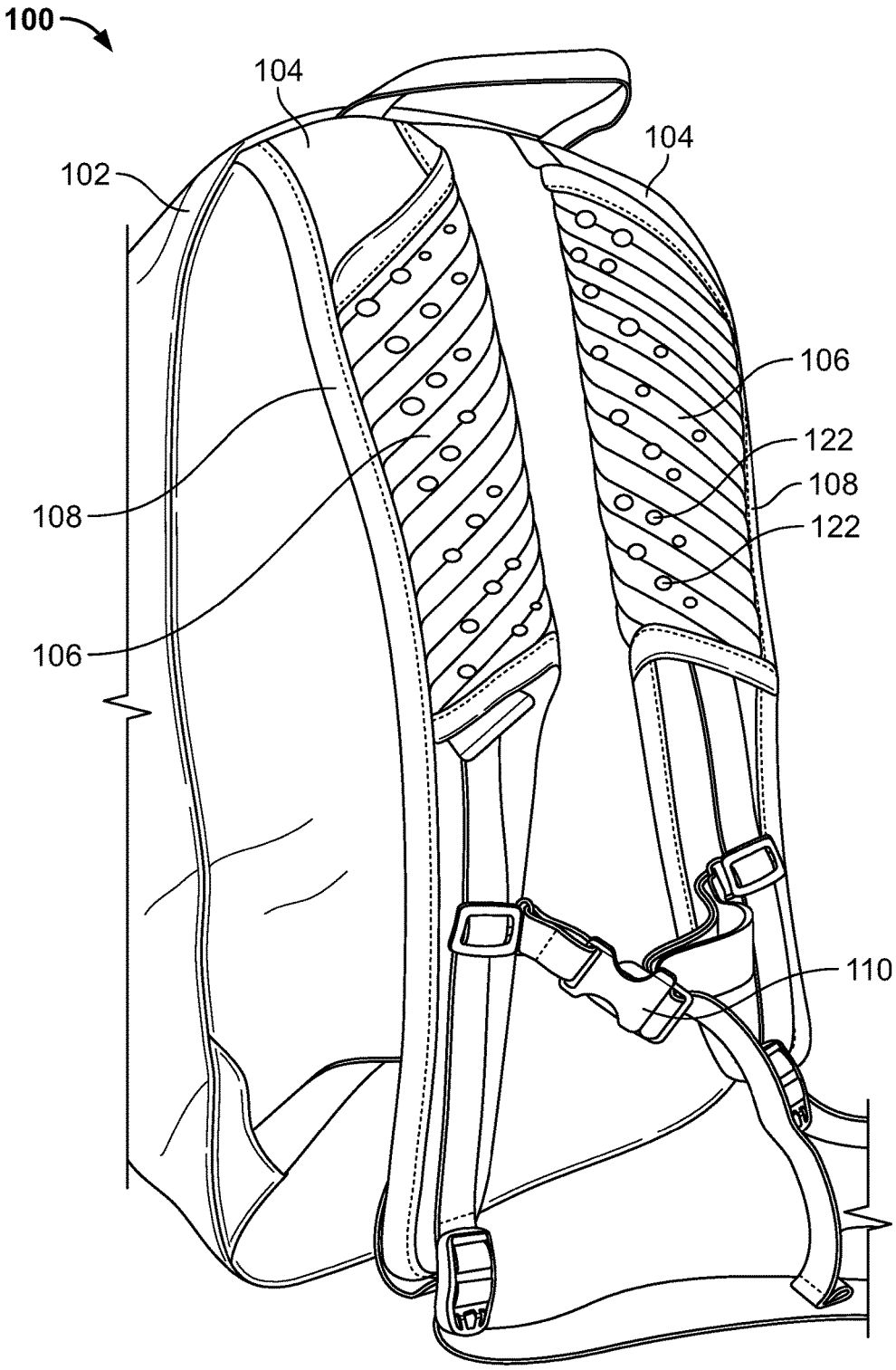
FIG. 1 shows an example first embodiment of a backpack with improved shoulder straps in accordance with the present invention.

One example of improved shoulder straps on a backpack in accordance with the present invention is shown in FIG. 1. Backpack 100 includes body 102, shoulder straps 104, fold-over panels, 106, and a sternum strap 110. The shoulder straps 104 are attached at one end to a top portion of body 102 and may be sewn into a top seam or attached by another suitable means.

The shoulder straps 104 include fold-over panels 106 which extend from an inner side of each shoulder strap 104. The inner side of each shoulder strap 104 is a side closest to the center of the body 102 and closest to a user's center when the user wears the backpack as intended. The fold-over panels 106 are folded over the shoulder straps 104 preferably away from the body 102, but may be folded over toward the body 102 in an alternate embodiment. When folded over the shoulder straps 104, the fold-over panels 106 are attached to an outer side 108 of each of the respective shoulder straps 104. The outer side 108 of each shoulder strap 104 is a side farthest from the center of the body 102 and farthest from a user's center when the user wears the backpack as intended. The fold-over panels 106 may be sewn into a seam along the outer sides 108 of the shoulder straps 104 or may be attached by another suitable means.

Figure 2:
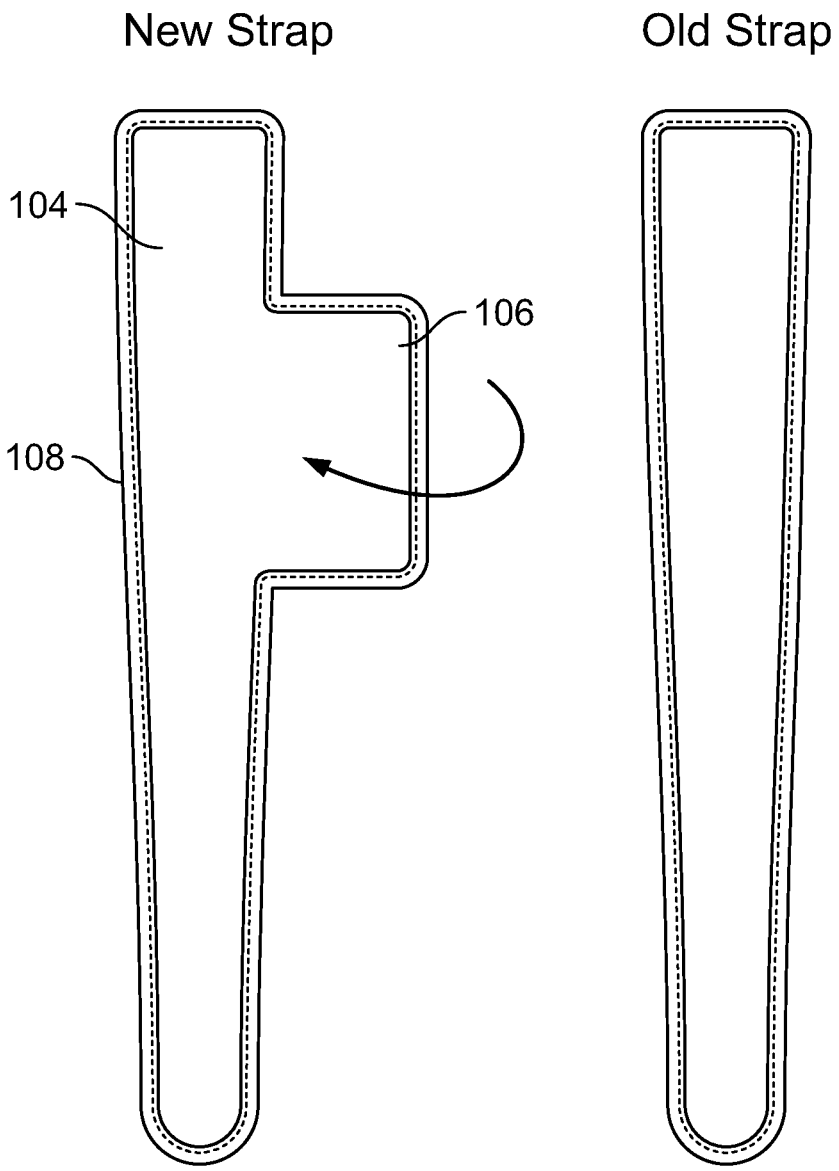
FIG. 2 shows an example configuration of an improved shoulder strap in accordance with certain embodiments of the present invention.

FIG. 2 further illustrates the geometry of a shoulder strap in accordance with the present invention. The shoulder strap 104 includes a fold-over panel 106 which extends from one side. The fold-over panel 106 is preferably rectangular or trapezoidal in shape, but it is contemplated that the fold-over panel 106 may take on other shapes. Preferably, the fold-over panel 106 is roughly as wide as the shoulder strap 104 so that when it is folded over the shoulder strap 104, it lies within the width profile of the shoulder strap 104. During construction, the fold-over panel is folded over the shoulder strap and attached to the outer side 108 of the shoulder strap 104. The fold-over panel 106 is formed on the shoulder strap 104 such that the combination of the shoulder strap 104 and fold-over panel 106 is an integrated and unitary element. Such a construction may be produced, for example, by a single die-cut of the base materials. This way, when shoulder-straps 104 with fold-over panels are worn with a backpack, the curvature of a user's neck and shoulders contacts the seamless transition between the shoulder straps 104 and the fold-over panels 106. The shoulder straps 104 depicted in FIGS. 1 and 2 are intended to promote comfort by substituting the gentle transition into the fold-over panels 106 for the abrasive constructions of traditional shoulder straps which orient seams or other uncomfortable constructions against a user's neck.

Shoulder straps 104 and fold-over panels 106 may be constructed with many different materials. An example construction may include 8 mm corrugated EVA foam for internal padding. The EVA foam may include perforations 122 throughout to improve air flow through the shoulder straps 104 and minimize the density of the padding, thus making the shoulder straps 104 lighter. Perforations 122 may be of varying sizing and spacing depending on the support needs of any particular padded area. On the undersides of the shoulder straps 104 and on the fold-over panels 106, the EVA foam may be covered by a 4-way stretch mesh. On the fronts of the shoulder straps 104, the EVA foam may be covered by a spacer mesh. The shoulder straps 104 may further be enclosed at the sides by a grosgrain binding and/or a herringbone poly twill binding.

Referring back to FIG. 1, backpack 100 may optionally include a sternum strap 110 for further securing the load on a user. Sternum strap 110 includes a buckle which may be adjusted for tightness in the horizontal direction and may also have an adjustable vertical position along the shoulder straps 104. Sternum strap 110 may be attached to each of the shoulder straps 104 via carriage straps that run along the shoulder straps 104. The carriage straps may be anchored to the shoulder straps 104 at a location underneath the fold-over panels 106 to conceal seams or other means of attachment.

Figure 3:
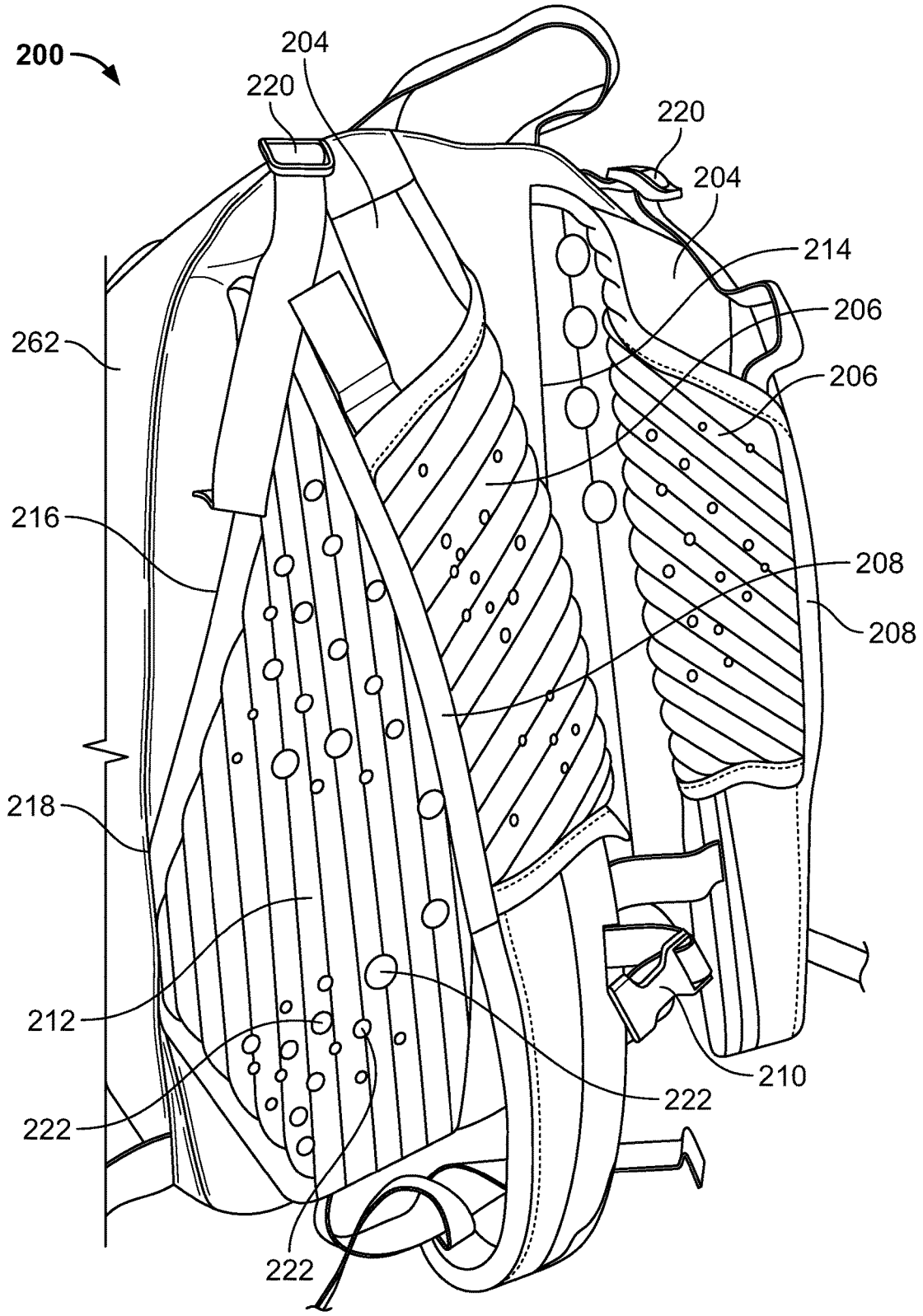
FIG. 3 shows an example second embodiment of a backpack with improved shoulder straps in accordance with the present invention.

FIG. 3 illustrates a second embodiment in accordance with the present invention. Backpack 200 includes body 202, shoulder straps 204, folder-over panels 206, a sternum strap 210, back panels 214, and load-stabilizing straps 220.

The shoulder straps 204 include fold-over panels 206 which extend from an inner side of each shoulder strap 204. The inner side of each shoulder strap 204 is a side closest to the center of the body 202 and closest to a user's center when the user wears the backpack as intended. The fold-over panels 206 are folded over the shoulder straps 204 preferably away from the body 202, but may be folded over toward the body in an alternate embodiment. When folded over the shoulder straps 204, the fold-over panels 206 are attached to an outer side 208 of each of the shoulder straps 204. The outer side 208 of each shoulder strap 204 is a side farthest from the center of the body 202 and farthest from a user's center when the user wears the backpack as intended. The fold-over panels 206 may be sewn into a seam along the outer sides 208 of the shoulder straps 204 or may be attached by another suitable means.

Fold-over panels 206 are preferably rectangular or trapezoidal in shape, but it is contemplated that fold-over panels 206 may take on other shapes. Preferably, fold-over panels 206 are roughly as wide as the shoulder straps 204 so that when they are folded over the shoulder straps 204, they lie within the width profile of the shoulder straps 204. During construction, the fold-over panels are folded over the shoulder straps 204 and attached to the outer sides 208 of the shoulder straps 204. Preferably, the fold-over panels 206 are formed on the shoulder straps 204 such that the combination of the shoulder straps 204 and fold-over panels 206 are integrated and unitary elements. Such a construction may be produced, for example, by a single die-cut of the base materials. This way, when shoulder straps 204 with fold-over panels 206 are worn with a backpack, the curvature of a user's neck and shoulders contacts the seamless transitions between the shoulder straps 204 and the fold-over panels 206.

Shoulder straps 204 further include back panels 212 which are attached to a back face of body 202. The inner sides 214 of back panels 212 are attached to the body via sewing or another suitable means of attachment. The inner side 214 of each back panel 212 is a side closest to the center of the body 202 and closest to a user's center when the user wears the backpack as intended. Outer side attached portions 218 of back panels 216 may also be attached to an outer edge of body 202 via sewing or another suitable means of attachment. Outer side attached portions 218 are preferably only attached to a lower portion of body 202 and unattached portions 216 of back panels 212 are not attached to the body 202 at all. Thus, upper portions of back panels 212 are free to articulate to conform to the curvature of a user's back. Back panels 212 may extend downward to a lower edge of the back face of body 202, effectively covering much of the back face of body 202 where it may contact a user's back.

Where the attachment between inner sides 214 and the body 202 end near the top of the body 202, shoulder straps 204 fold over and extend downward. Shoulder straps 204 and back panels 212 are constructed such that the combination of the shoulder straps 204 and respective back panels 212 are integrated and unitary elements. Such a construction may be produced, for example, by a single die-cut of the base materials. When back panels 212 are integrated with shoulder straps 204, the interface between these elements and a user's shoulders and back is smoother than with traditional backpacks, thus reducing pressure points and promoting comfort.

It should be noted that because each shoulder strap 204 is integrated with a fold-over panel 206 and a back panel 212, the three elements together may be produced, for example, by a single die-cut of the base materials.

Shoulder straps 204, fold-over panels 206, and back panels 212 may be constructed with many different materials. An example construction may include 8 mm corrugated EVA foam for internal padding. The EVA foam may include perforations throughout to improve air flow and minimize the density of the padding, thus making the backpack 200 lighter. On the undersides of the shoulder straps 204, the fold-over panels 206, and the back panels 212, the EVA foam may be covered by a 4-way stretch mesh. On the fronts of the shoulder straps 204, the EVA foam may be covered by a spacer mesh. The shoulder straps 204 may further be enclosed at the sides by a grosgrain binding and/or a herringbone poly twill binding.

Backpack 200 further includes load-stabilizing straps 220 which attach at one end to the top of the body 202 and respectively at another end to one of the shoulder straps 204. The load-stabilizing straps 220 may be sewn into a top seam of the body 202 or may be attached by another suitable method. Load-stabilizing straps 220 may include ladder locks such that a user can adjust their length. By adjusting the length of load-stabilizing straps 220, a user can effectively adjust the position of the load on her shoulders and back. Tightening load-stabilizing straps 220 raises the body 202 up on a user's shoulders and back, whereas loosening load-stabilizing strap 220 lowers the body 202 on the user's shoulders and back. Load-stabilizing straps 220 may be attached to shoulder straps 204 underneath fold-over panels 206 so as to hide sewing seams or the like.

Backpack 200 may optionally include a sternum strap 210 for further securing the load on a user. Sternum strap 210 includes a buckle which may be adjusted for tightness in the horizontal direction and may also have an adjustable vertical position along the shoulder straps 204. Sternum strap 210 may be attached to each of the shoulder straps 104 via carriage straps that run along the shoulder straps 204. The carriage straps may be anchored to the shoulder straps 104 at a location underneath the fold-over panels 206 to conceal seams or other means of attachment.

Figure 4:
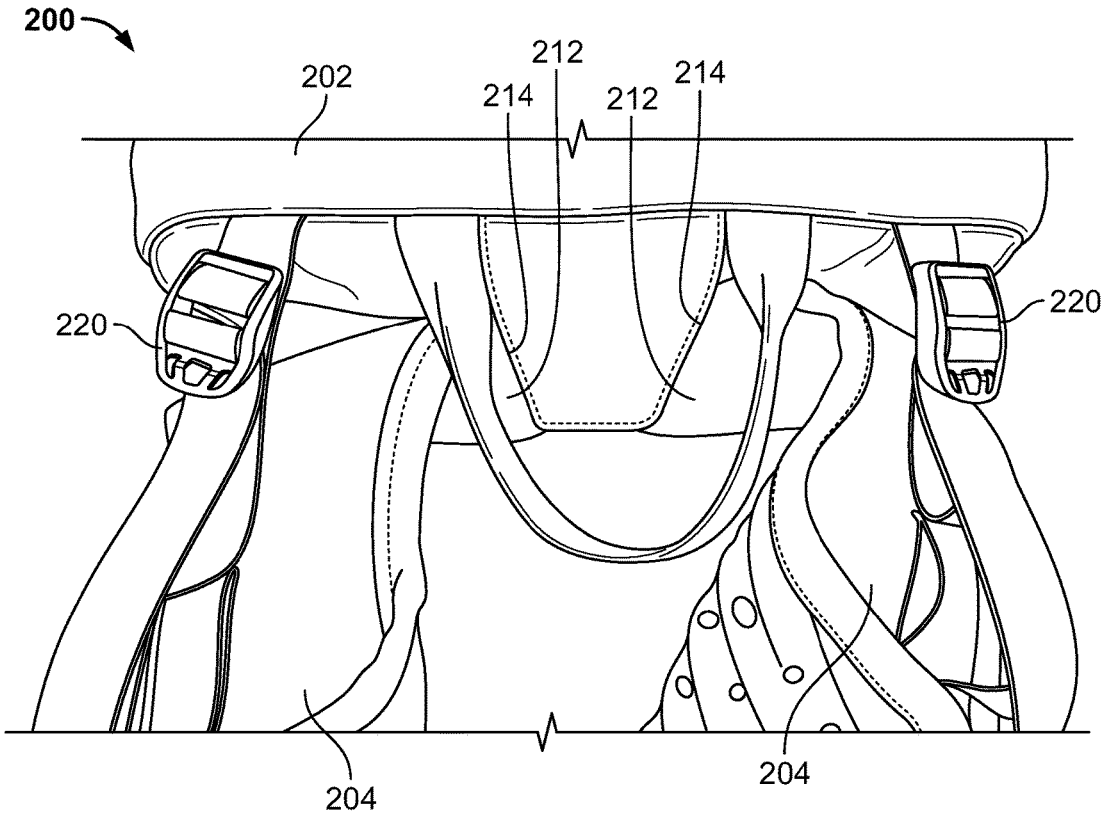
FIG. 4 shows a top-down view of an example second embodiment of a backpack with improved shoulder straps in accordance with the present invention.

FIG. 4 illustrates a top-down view of the embodiment shown in FIG. 3. Back panels 212 are attached to body 202 along their inner sides but top portions of back panels 212 are free to pull away from body 202 and articulate about inner sides 214.

Figure 5:
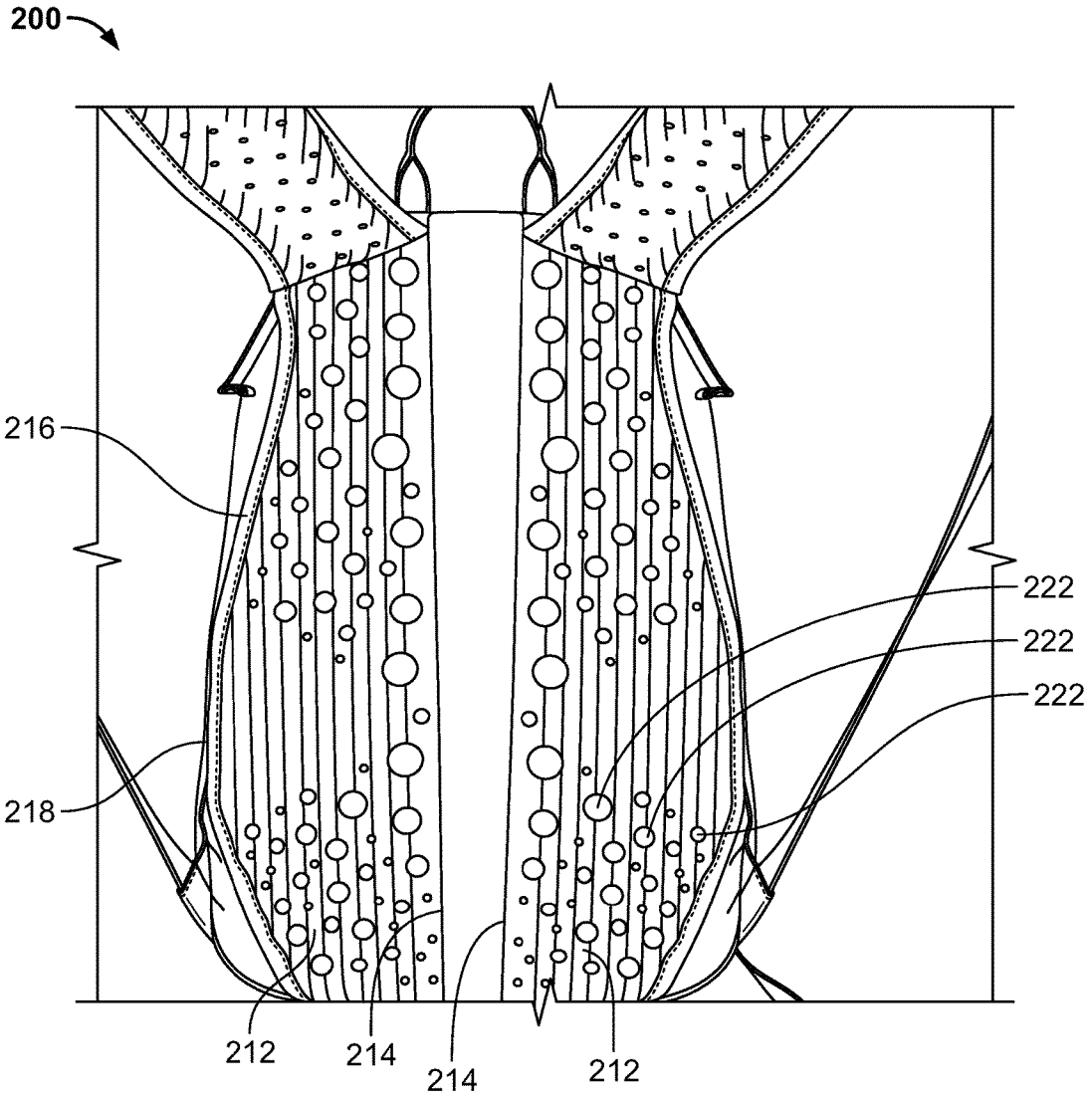
FIG. 5 shows the back panels of an example second embodiment of a backpack with improved shoulder straps in accordance with the present invention.

FIG. 5 illustrates a direct view of back panels 212 of the embodiment shown in FIG. 3 with shoulder straps 204 lifted out of view. Back panels 212 include perforations 222 throughout to improve air flow and minimize the density of the padding, thus making the back panels 212 lighter. Perforations 222 may be of varying sizing and spacing depending on the support needs of any particular padded area.

Figure 6:
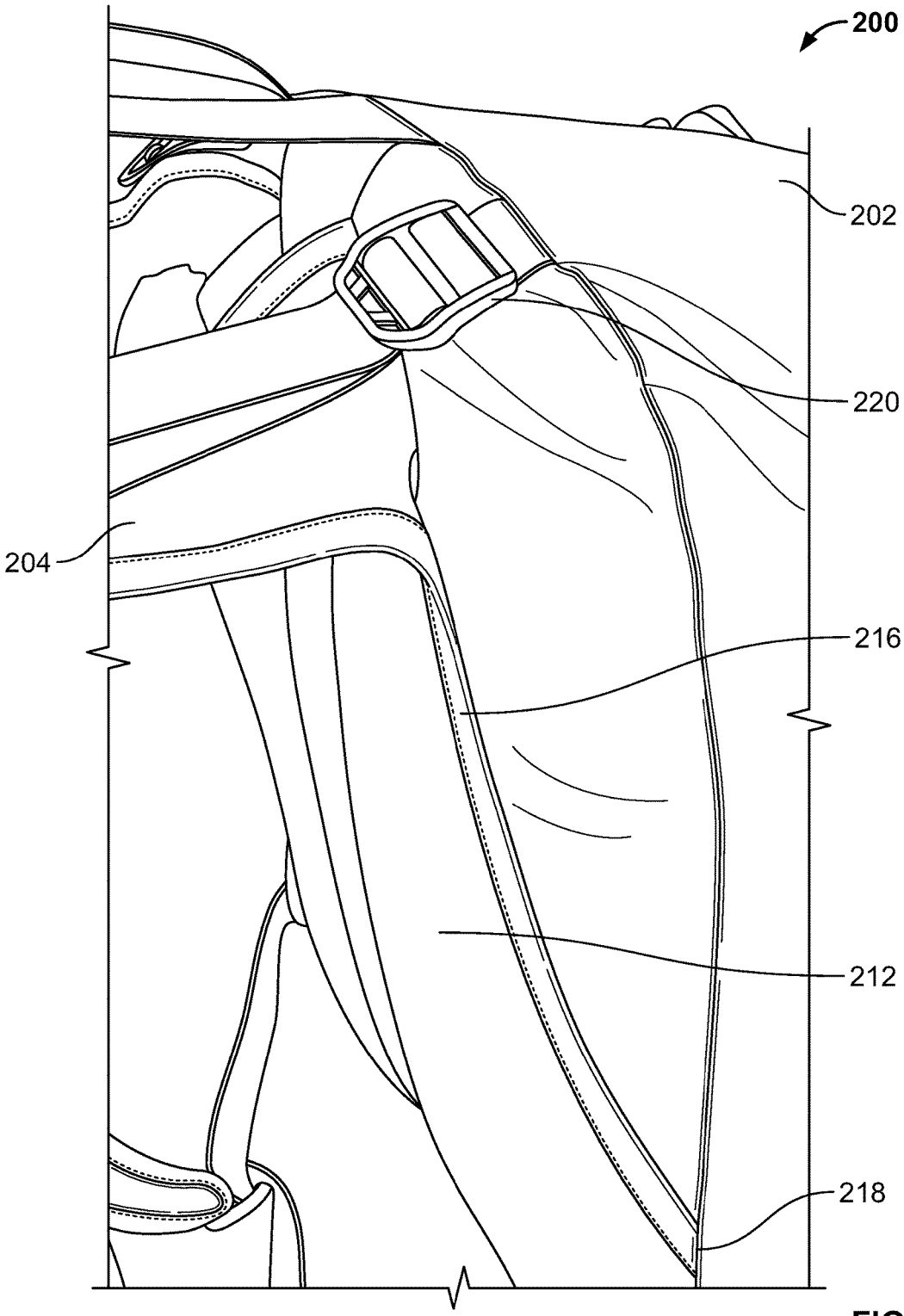
FIG. 6 shows a side view of an example second embodiment of a backpack with improved shoulder straps in accordance with the present invention.
Figure 7:
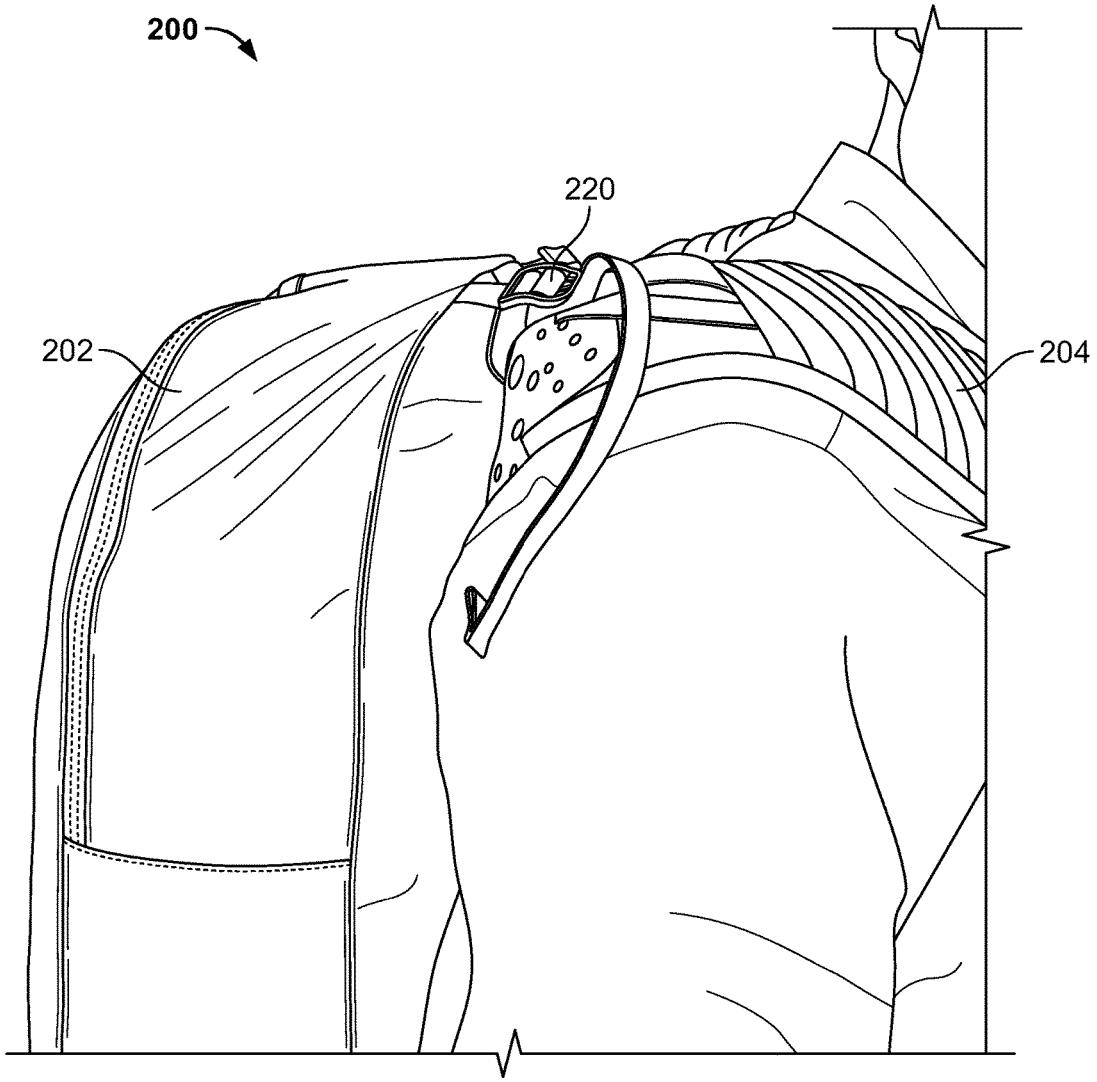
FIG. 7 shows an alternate side view of an example second embodiment of a backpack with improved shoulder straps in accordance with the present invention.

FIG. 6 and FIG. 7 further illustrate side views of the embodiment shown in FIG. 3.

Figure 8:
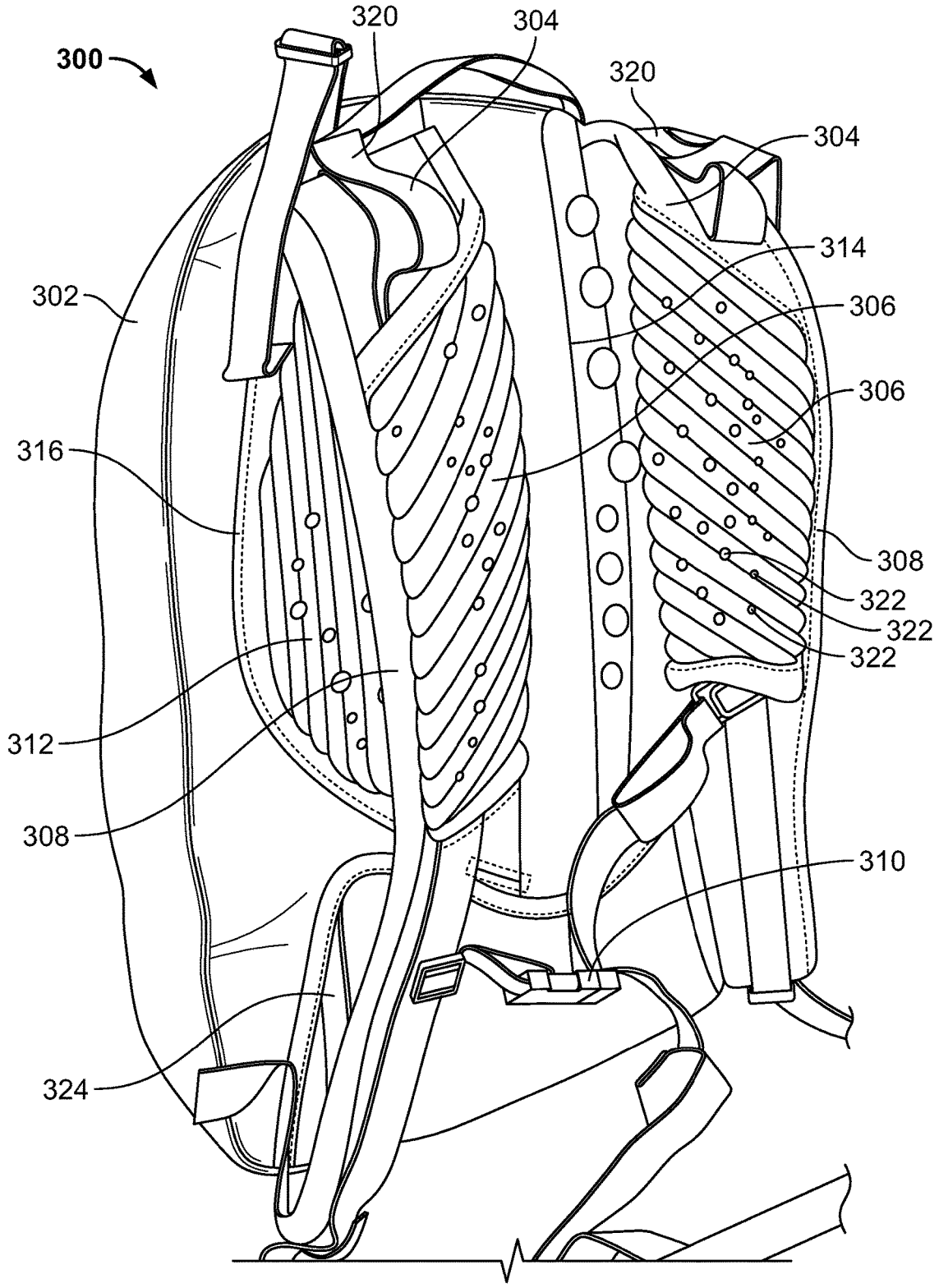
FIG. 8 shows an example third embodiment of a backpack with improved shoulder straps in accordance with the present invention.

FIG. 8 illustrates a third embodiment in accordance with the present invention. Backpack 300 includes body 302, shoulder straps 304, folder-over panels 306, a sternum strap 310, back panels 314, load-stabilizing straps 320, and lumbar panel 324.

The shoulder straps 304 include fold-over panels 306 which extend from an inner side of each shoulder strap 304. The inner side of each shoulder strap 304 is a side closest to the center of the body 302 and closest to a user's center when the user wears the backpack as intended. The fold-over panels 306 are folded over the shoulder straps 304 preferably away from the body 302, but may be folded over toward the body in an alternate embodiment. When folded over the shoulder straps 304, the fold-over panels 306 are attached to an outer side 308 of each of the shoulder straps 304. The outer side 308 of each shoulder strap 304 is a side farthest from the center of the body 302 and farthest from a user's center when the user wears the backpack as intended. The fold-over panels 306 may be sewn into a seam along the outer sides 308 of the shoulder straps 304 or may be attached by another suitable means.

Fold-over panels 306 are preferably rectangular or trapezoidal in shape, but it is contemplated that fold-over panels 306 may take on other shapes. Preferably, fold-over panels 306 are roughly as wide as the shoulder straps 304 so that when they are folded over the shoulder straps 304, they lie within the width profile of the shoulder straps 304. During construction, the fold-over panels 306 are folded over the shoulder straps 304 and attached to the outer sides 308 of the shoulder straps 304. The fold-over panels 306 are formed on the shoulder straps 304 such that the combination of the shoulder straps 304 and fold-over panels 306 are integrated and unitary elements. Such a construction may be produced, for example, by a single die-cut of the base materials. This way, when shoulder-straps 304 with fold-over panels 306 are worn with a backpack, the curvature of a user's neck and shoulders contacts the seamless transitions between the shoulder straps 304 and the fold-over panels 306.

Shoulder straps 304 further include back panels 312 which are attached to a back face of body 302. The inner sides 314 of back panels 312 are attached to the body via sewing or another suitable means of attachment. The inner side 314 of each back panel 312 is a side closest to the center of the body 302 and closest to a user's center when the user wears the backpack as intended. Unattached portions 316 of back panels 312 are not attached to the body 302 at all. Thus, back panels 312 are free to articulate about inner sides 314 to conform to the curvature of a user's back. Lower on body 302 beneath back panels 312 is a lumbar panel 324 for providing support to a user's lower back. Lumbar panel 324 may be attached along a bottom seam of body 302 and extend upward as far as back panels 312.

Where the attachment between inner sides 314 and the body 302 end near the top of the body 302, shoulder straps 304 fold over and extend downward. Shoulder straps 304 and back panels 312 are constructed such that the combination of the shoulder straps 304 and respective back panels 312 are integrated and unitary elements. Such a construction may be produced, for example, by a single die-cut of the base materials. When back panels 312 are integrated with shoulder straps 304, the interface between these elements and a user's shoulders and back is smoother than with traditional backpacks, thus reducing pressure points and promoting comfort.

It should be noted that because each shoulder strap 304 is integrated with a fold-over panel 306 and a back panel 312, the three elements together may be produced, for example, by a single die-cut of the base materials.

Shoulder straps 304, fold-over panels 306, back panels 312, and lumbar panel 324 may be constructed with many different materials. An example construction may include 8 mm corrugated EVA foam for internal padding of the aforementioned elements. The EVA foam may include perforations 322 throughout to improve air flow and minimize the density of the padding, thus making the backpack 300 lighter. Perforations 322 may be of varying sizing and spacing depending on the support needs of any particular padded area. On the undersides of the shoulder straps 304, the fold-over panels 306, the back panels 312, and the lumbar panel 324 the EVA foam may be covered by a 4-way stretch mesh. On the fronts of the shoulder straps 304, the EVA foam may be covered by a spacer mesh. The shoulder straps 304 may further be enclosed at the sides by a grosgrain binding and/or a herringbone poly twill binding.

Backpack 300 further includes load-stabilizing straps 320 which attach at one end to the top of the body 302 and respectively at another end to one of the shoulder straps 304. The load-stabilizing straps 320 may be sewn into a top seam of the body 302 or may be attached by another suitable method. Load-stabilizing straps 320 may include ladder locks such that a user can adjust their length. By adjusting the length of load-stabilizing straps 320, a user can effectively adjust the position of the load on her shoulders and back. Tightening load-stabilizing straps 320 raises the body 302 up on a user's shoulders and back, whereas loosening load-stabilizing strap 320 lowers the body 302 on the user's shoulders and back. Load-stabilizing straps 320 may be attached to shoulder straps 304 underneath fold-over panels 306 so as to hide sewing seams or the like.

Figure 9:
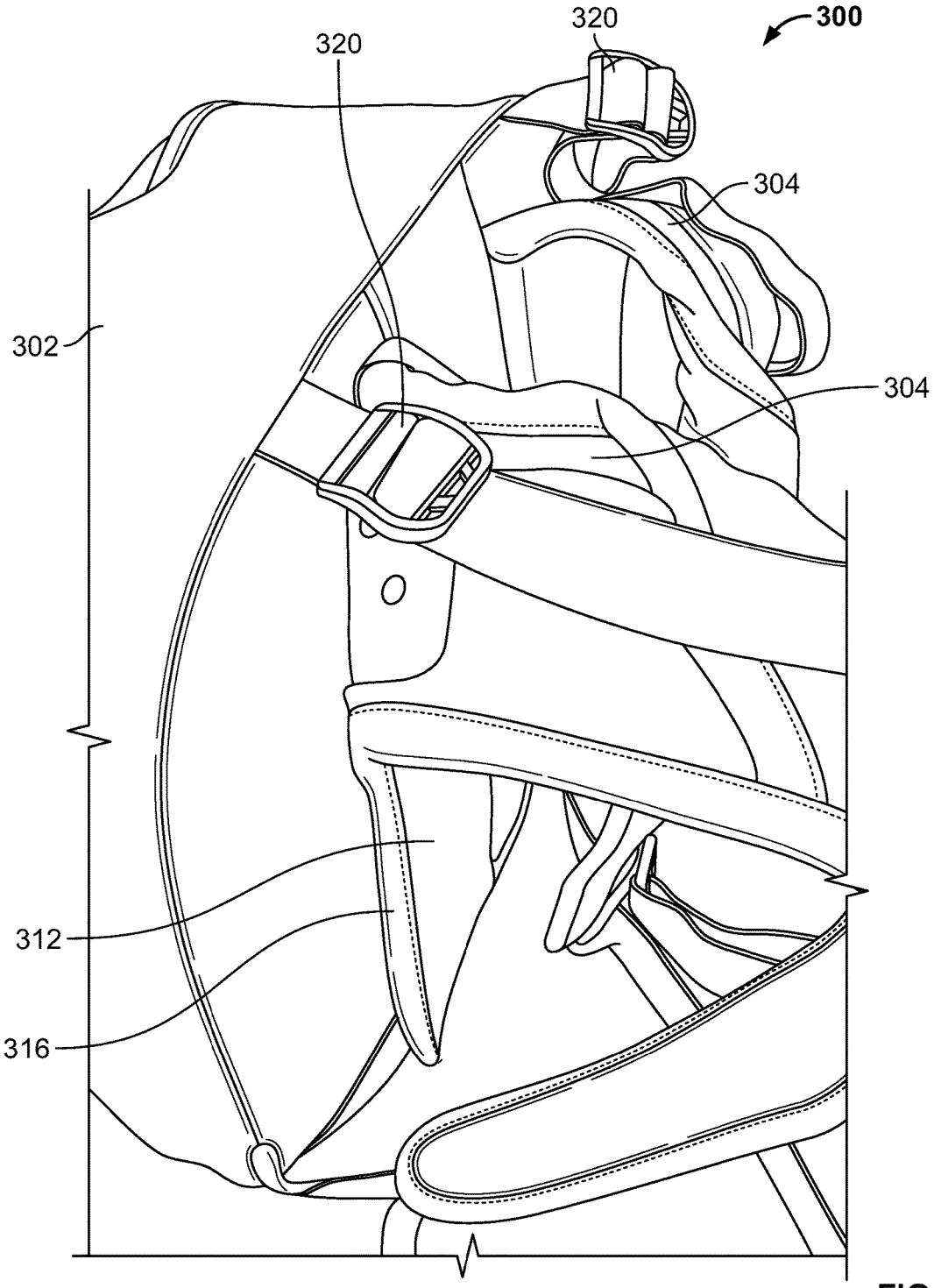
FIG. 9 shows an alternate view of an example third embodiment of a backpack with improved shoulder straps in accordance with the present invention.

FIG. 9 illustrates another view of the embodiment shown in FIG. 8. Back panels 312 are attached to body 302 along their inner sides 314 but unattached portions 316 are free to pull away from body 302 and articulate about inner sides 314. This allows the back panels 312 integrated with shoulder straps 304 to more closely conform to the contours of a user's back and shoulders, thus promoting comfort.

While various embodiments have been described, other embodiments are plausible. It should be understood that the foregoing descriptions of various examples of a backpack with improved shoulder straps are not intended to be limiting, and any number of modifications, combinations, and alternatives of the examples may be employed.

The examples described herein are merely illustrative, as numerous other embodiments may be implemented without departing from the spirit and scope of the present invention. Moreover, while certain features of the invention may be described above only in the context of certain examples or configurations, these features may be exchanged, added, and removed from and between the various embodiments or configurations while remaining within the scope of the invention.

We claim:

1. A backpack, comprising:

a body;

a first shoulder strap including a first back panel, wherein:

an inner side of the first back panel is attached to the body, at least a portion of the outer side of the first back panel is unattached to the body such that at least an upper portion of the first back panel is free to articulate about the inner side of the first back panel, and the first shoulder strap folds where the attachment between the inner side of the first back panel and the body ends;

a second shoulder strap including a second back panel, wherein:

an inner side of the second back panel is attached to the body at least a portion of the outer side of the second back panel is unattached to the body such that at least an upper portion of the second back panel is free to articulate about the inner side of the second back panel, and the second shoulder strap folds where the attachment between the inner side of the first back panel and the body ends;

a first load-stabilizing strap attached to the body and the first shoulder strap;

a second load-stabilizing strap attached to the body and the second shoulder strap;

a first fold-over panel, the first fold-over panel being formed on the first shoulder strap, wherein the first fold-over panel extends from an inner side of the first shoulder strap, folds over the first shoulder strap, and attaches to an outer side of the first shoulder strap; and a second fold-over panel, the second fold-over panel being formed on the second shoulder strap, wherein the second fold-over panel extends from an inner side of the second shoulder strap, folds over the second shoulder strap, and attaches to an outer side of the second shoulder strap.

2. The backpack of claim 1, wherein the outer side of the first back panel and the outer side of the second back panel are unattached to the body such that the are free to articulate about the inner sides of the back panels.

3. The backpack of claim 1, wherein the first back panel and the second back panel extend to a lower seam of the body.

4. The backpack of claim 1, further comprising a lumbar panel attached to the body below the back panels.

5. The backpack of claim 1, wherein the first fold-over panel and the second fold-over panel fold over the first shoulder strap and the second shoulder strap respectively in a direction opposite of the body.

6. The backpack of claim 1, wherein the first fold-over panel and the second fold-over panel are integrated with the first shoulder strap and the second shoulder strap respectively.

7. The backpack of claim 1, wherein the first back panel and the second back panel are integrated with the first shoulder strap and the second shoulder strap respectively.

8. The backpack of claim 1, wherein the fold-over panels, the shoulder straps, and the back panels are constructed with a perforated foam.

9. The backpack of claim 1, wherein the fold-over panels, the shoulder straps, and the back panels are formed with a single die-cut of material.

10. The backpack of claim 1, wherein a sternum strap is attached to the first shoulder strap underneath the first fold-over panel and is attached to the second shoulder strap underneath the second fold-over panel.

11. The backpack of claim 1, wherein:

the first load-stabilizing strap is attached to the first shoulder strap underneath the first fold-over panel; and the second load-stabilizing strap is attached to the second shoulder strap underneath the second fold-over panel.

* * * * *